United States Patent [19]

Bell

[11] 4,175,470

[45] Nov. 27, 1979

[54] GUN WITH RAPID FIRING RATE

[75] Inventor: Frank H. Bell, Brigham City, Utah

[73] Assignee: Thiokol Corporation, Newtown, Pa.

[21] Appl. No.: 863,376

[22] Filed: Dec. 22, 1977

[51] Int. Cl.[2] ..... F41C 13/00

[52] U.S. Cl. ..... 89/7; 89/33 R

[58] Field of Search ..... 89/7, 33 R, 33 B; 102/38 MM

[56] References Cited

U.S. PATENT DOCUMENTS 3,331,282 7/1967 McGowan ..... 89/33 B

FOREIGN PATENT DOCUMENTS 126071 5/1919 United Kingdom ..... 89/7

631498 11/1949 United Kingdom ..... 89/7

*Primary Examiner*—Stephen C. Bentley

*Attorney, Agent, or Firm*—Stanley A. Marcus; Edward E. McCullough

[57] ABSTRACT

A gun has a projectile housing and a cartridge chamber, aft thereof, aligned between a barrel and a breech bolt containing a striker. The striker is positioned to impact on primer caps of expendable propellant cartridges, which are placed in the cartridge chamber from a spring-loaded magazine or other conventional means and then ejected when spent. A helical projectile duct, concentric with a bore in the projectile housing intersects the bore just forward of the intersection of the bore with the cartridge chamber, for automatically placing projectiles, one by one, into the bore. A gas port leading from the cartridge chamber enters the projectile duct at a distance from the intersection of that duct with the bore such that gas therefrom will urge a selected number of projectiles into the bore whenever a cartridge is fired. A short venturi tube fixed into the intersection of the bore with the cartridge chamber performs the dual function of accelerating propellant gases and preventing projectiles from entering the cartridge chamber during changes of cartridges. This venturi also enhances the low-pressure characteristics of the main jet of propellant gases in the bore, so that, in cooperation with the back pressure exerted on the projectiles by gases from the gas port, a selected number of projectiles are delivered to the bore whenever a cartridge is fired.

4 Claims, 2 Drawing Figures

12
11
14
13
10
15
9
6
8
19
17
18
16
18
7
2
2
20
5
4

19
6
7
18
4
17
16
20

GUN WITH RAPID FIRING RATE

BACKGROUND OF THE INVENTION

This invention relates broadly to guns having very high firing rates. In particular, it relates to guns, especially adaptable to aircraft, that are capable of firing multiple projectiles with one propellant charge. The Government has rights to this invention pursuant to Contract DAAD05-74-C-0794, awarded by the U.S. Army.

In aerial warfare, the crossing rates of two supersonic fighter aircraft relative to each other can easily exceed 2,000 miles per hour. At these high speeds even a gatling style cannon does not have a rate of fire equal to the combat requirements. There is a need for rates of fire exceeding 15,000 projectiles per minute. Present weapons have an upper limit of 6,000 projectiles per minute.

Cartridges having a number of projectiles that are fired serially by a single propellant charge are described in "Ordnance," pages 384–387, March -April 1973. However, such cartridges can carry a very limited number of projectiles, and would not be significantly more useful in aerial warfare than cartridges having single projectiles.

SUMMARY OF THE INVENTION

A primary object of the present invention is to fill this deficiency of the prior art by providing a gun capable of discharging a selected number of projectiles in very rapid succession. This is accomplished by injecting gases from a propellant combustion chamber behind the desired number of projectiles in a projectile duct to force them into the bore of the gun. By this means a number of projectiles are discharged whenever a single propellant cartridge is fired.

Another object of the invention is to accomplish the above objective with no moving parts, and, hence, to promote reliability and simplicity of manufacture.

Other objects and advantages of the invention will become apparent as the following, detailed description is read with reference to the accompanying drawings. The same numbers refer to the same parts throughout the disclosure.

DESCRIPTION OF THE PREFERRED EMBODIMENTS

Figure 1:
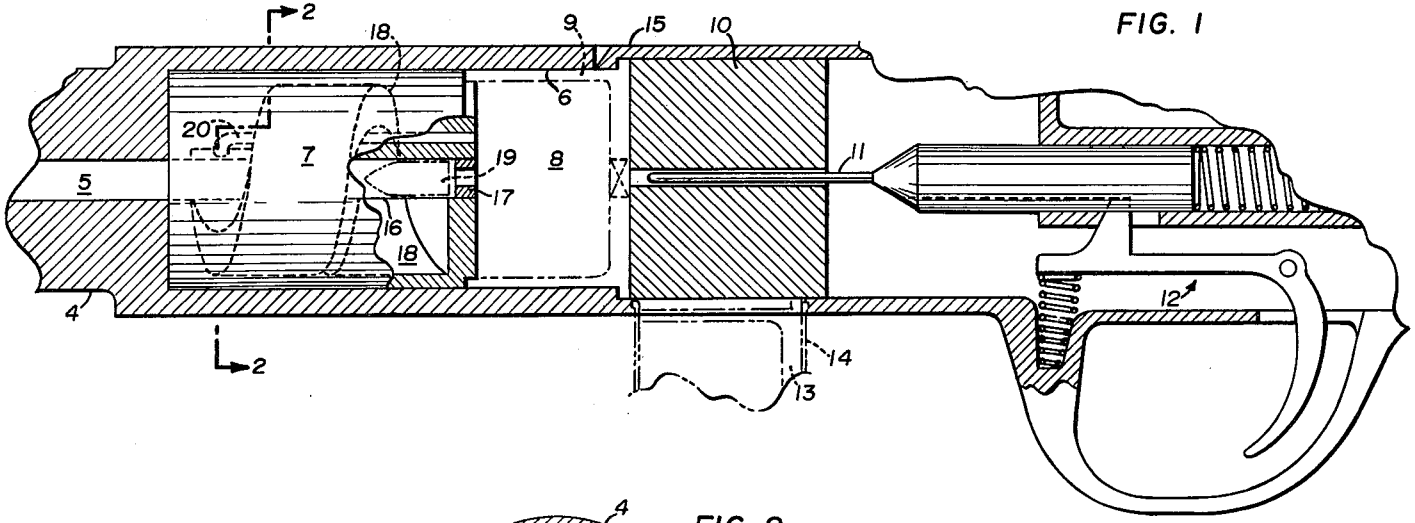
FIG. 1 is a fragmentary, longitudinal section of the invention.
Figure 2:
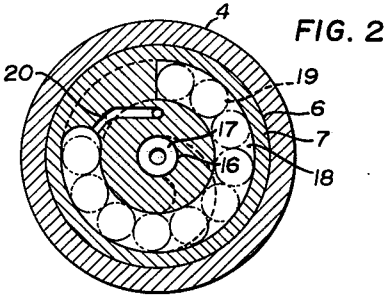
FIG. 2 is a full, cross-sectional view taken on Line 2—2 of FIG. 1.

As shown in FIG. 1, the present invention is an improved firing system that is installed in an otherwise conventional firearm.

A barrel 4 has a longitudinal bore 5 extending through it, for discharging a projectile, and a counterbore 6 in the aft end thereof. The counterbore contains a special, projectile housing 7 and a chamber 8 for a propellant cartridge 9 aft of the housing 7. The enclosure for the chamber 8 is completed on the aft side by the breech bolt 10, which contains a striker 11 operated by a conventional trigger mechanism 12.

Propellant cartridges 13 are fed into the propellant cartridge chamber 8 from a spring-loaded magazine 14 by pulling back the breech bolt in a conventional manner until it clears the opening to the magazine 14. According to prior-art practice, this action, in cooperation with an extraction device 15, simultaneously ejects a spent propellant cartridge 13 and cocks the striker 11. A new propellant cartridge 13 is placed into the propellant cartridge chamber 8 by moving the breech bolt forward, after the cartridge has been moved in line therewith by spring action of the magazine 14.

The projectile housing 7 is preferably a steel cylinder having a central bore 16 extending through it in alignment with that bore 5 of the barrel 4. A short venturi tube 17 is installed in the aft end of the bore 16. A duct 18 for storage of projectiles 19 has the form of a cylindrical helix concentric with the bore 16, and joins the bore 16 just forward of the venturi tube 17. A gas port 20 joins the propellant cartridge chamber 8 to the projectile duct 18, to permit gas pressure from the chamber 8 to enter the projectile duct 18 when a propellant cartridge 13 is fired.

Since the main stream of gas flows through the bores 5 and 16 when a propellant cartridge 13 is fired; and, since these gases are accelerated further by the venturi tube 17, pressure on the projectiles 19 near the gas port 20 will be considerably greater than it is at the juncture of the projectile duct 18 with the bore 16. Hence, the projectiles 19 between the gas port 20 and the bore 16 will be forced, one by one, into the bore 16 by this Bernoulli effect. For this reason, the exact number of projectiles 19 to be ejected with each firing of a single propellant cartridge 13 can be preselected, simply by making the distance between the juncture of the gas port 20 with the projectile duct 18 and the juncture of the projectile duct 18 with the bore 16 to be equal to the sum of the diameters of the desired number of projectiles 19.

The venturi tube 17, being smaller in diameter than the projectiles 19, performs the additional function of preventing projectiles 19 from entering the propellant chamber 8.

An invention has been described that provides an advance in the firearm art. Although the preferred embodiment has been described with considerable specificity, it should be noted that many details thereof may be altered without departing from the scope of the invention, as it is defined in the following claims.

The invention claimed is:

1. In a gun having a barrel with a central bore therethrough, and a propellant-cartridge chamber and trigger-operated striker aligned with the bore, the improvement comprising:

a housing, seated between the propellant-cartridge chamber and the bore, having a projectile duct for storing projectiles, a bore alignable with that of the barrel and intersecting both the projectile duct and the propellant-cartridge chamber, and a gas port joining the propellant-cartridge chamber with the projectile duct, entering the projectile duct at a distance from intersection of the projectile duct with the bore that is equal to the sum of the diameters of the number of projectiles selected to be ejected when a single propellant cartridge is fired.

2. The gun of claim 1 further including a venturi tube at the intersection of the projectile housing bore with the propellant-cartridge chamber to accelerate the gases passing therethrough and enhance the Bernoulli effect to deliver projectiles into the bore, also, the venturi throat being smaller in diameter than the projectiles, whereby the projectiles are prevented from entering the propellant-cartridge chamber.

3. The gun of claim 1 wherein the projectile duct is in the form of a cylindrical helix concentric with the bore.

4. In a gun having a barrel with a central bore therethrough and a propellant-cartridge chamber with a trigger-operated striker aft thereof, the improvement comprising:

a housing, positioned between the bore and the propellant-cartridge chamber, having a bore extending from the propellant-cartridge chamber to the bore of the barrel, and in alignment therewith, a helical projectile duct, concentric about the housing bore and entering the housing bore adjacent the propellant-cartridge chamber and a gas port extending from the propellant-cartridge chamber to the projectile duct, joining the projectile duct at a distance from its juncture with the housing bore that is equal to the sum of the diameters of the number of projectiles that are to be ejected from the gun by a single propellant cartridge; and a venturi tube at the juncture of the housing bore with the propellant-cartridge chamber.

* * * * *